United States Patent [19]

Castarede

[11] 4,221,196

[45] Sep. 9, 1980

[54] LINER FOR INTERNAL COMBUSTION ENGINE

[75] Inventor: Armand Castarede, Meudon la Foret, France

[73] Assignee: Regie Nationale des Usines Renault, Boulogne-Billancourt, France

[21] Appl. No.: 973,935

[22] Filed: Dec. 28, 1978

[30] Foreign Application Priority Data

Jan. 3, 1978 [FR] France ..... 78 00033

[51] Int. Cl.[3] ..... F02F 1/16

[52] U.S. Cl. ..... 123/41.84; 123/193 C; 92/171

[58] Field of Search ..... 123/193 C, 193 CH, 41.84, 123/41.83, 41.81, 41.71, 41.67; 92/169, 171

[56] References Cited

U.S. PATENT DOCUMENTS 1,177,162 3/1916 Zona ..... 123/41.67

FOREIGN PATENT DOCUMENTS 609917 8/1926 France ..... 123/41.84

1043913 11/1953 France ..... 123/193 C

*Primary Examiner*—Charles J. Myhre

*Assistant Examiner*—Craig R. Feinberg

*Attorney, Agent, or Firm*—Oblon, Fisher, Spivak, McClelland & Maier

[57] ABSTRACT

The present invention provides liner for internal combustion engines of the compressed type, in particular for Diesel engines with precombustion chambers. In the liner, the thickness of the compressed portion is reinforced while maintaining a reduced interaxial distance between cylinders by providing two opposed longitudinal flats perpendicular to the plane of the cylinders. The resultant reduced thickness of the liner is compensated for by a connection of the flats to the surface of the liner by concave round offs which form reinforcements of thickness on either side of the thinnest zone. Longitudinal reinforcing ribs, essentially equidistant with each other and the reinforcements, are distributed on the periphery of the liner.

5 Claims, 4 Drawing Figures

LINER FOR INTERNAL COMBUSTION ENGINE

BACKGROUND OF THE INVENTION

Field of the Invention

The present invention relates to an improvement in the performance of liners called "wet and compressed" liners, installed in the cylinder blocks of internal combustion engines and particularly Diesel engines with precombustion chambers.

The advantages inherent in the use of wet and compressed liners installed in cylinder blocks have long been known (simplification of the casting and machining of blocks, whether of cast iron or aluminum; the possiblity of using a cylinder block of aluminum cast under pressure, without encountering the difficulties of casting borings and those caused by friction of pistons in the aluminum; the possibility of employing a cast iron more suitable in terms of friction and cast by centriugation to improve the constancy of its characteristics; great ease in replacing liners and pistons in case of repair without tearing down the motor block and without reboring, etc.).

The liners called "suspended", unlike those called "compressed", have on their upper part, a cylindrical flange for their support in the cylinder block. This entails large interaxial distances between cylinders and vaults or reinforcements in the intercylinder plane to avoid the depression of the liner when tightening down the cylinder head. Further, the cooling of the upper part of the liner is from beneath the support of the flange, which reduces its effectiveness in the hottest zone.

The liners called "compressed" do not involve this construction, their support being at the bottom of the cylinder block water jacket. The absence here of a flange thus permits better cooling of the upper part.

O-ring sealing systems permit then, the reduction of the surface of support of the liner as a function of the allowable value of the support pressure limit, called that of caulking, which depends on the resistance of the materials in contact.

Flats can be provided on the liners to diminish the interaxial distance between cylinders and, consequently, the length of the motor. This type of liner works under compression, in the portion corresponding to the distance between its lower support and its upper face, when the cylinder head is tightened down.

SUMMARY OF THE INVENTION

Thus it is an object of this invention to avoid too large deformations, to minimize the deformation of this portion and to make it as rigid as possible.

This is achieved, without harm to liner installation and, consequently, to motor dimensions, by the addition of longitudinal ribs at certain places around the liner periphery. The utilization of rib material is particularly more interesting than increasing the thickness of the liner to the detriment of motor weight and heat exchanging. The shape and placement of these ribs should be compatible with casting in a centrifuged chill-mold to retain the benefit of this type of fabrication. They will be very spread-out and therefore will present a large lateral surface allowing good removal of heat.

The flats in the intercylinder plane will be sufficiently extended to form, at each lateral extremity, a rib joining with the liner barrel to give rigidity to the compressed portion of the liner. The ovalization of the liner under the action of cylinder head tightening, tightening which can be accentuated to obtain better sealing and greater longevity of the head gasket or to avoid retightening, is thereby considerably reduced which decreases piston wear and energy consuming friction.

The principal defect of "compressed" liners thus disappears and permits extending their use to the most demanding configurations while retaining only the advantages.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
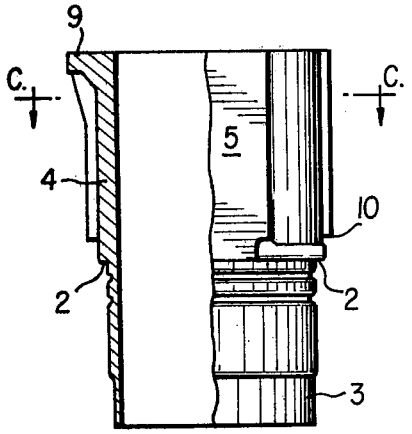
FIG. 1 represents, in elevation and half-section, a compressed liner constructed according to the invention, the half-section showing the thickness of the supporting ear of the prechamber.
Figure 2:
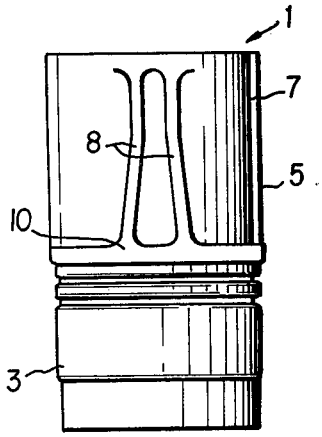
FIG. 2 is a view from the left showing the stiffening ribs starting from this support ear.
Figure 3:
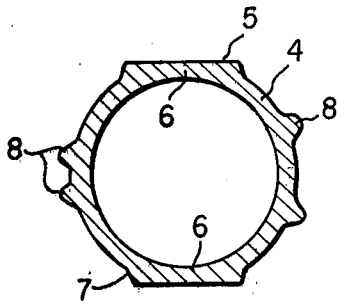
FIG. 3 shows a transverse section of the liner at the level C.
Figure 4:
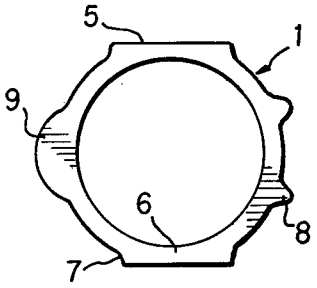
FIG. 4 is a view from above showing the contour of the upper rim and its supporting ear of the combustion chamber.

The liner thus represented is installed in a compressed condition with its face 1 contacting the cylinder head and its shoulder 2 inside the cylinder block (not shown). The liner is prolonged by a skirt 3. The compressed portion between 1 and 2 exhibits, in addition to its reinforced thickness 4 on the one hand, two diametrically opposed flats 5 which are perpendicular to the plane of alignment of cylinders and permitting reduction of the interaxial distance between cylinders, and a resultant reduction in the thickness which is compensated for by the rounded junctions 7 with the cylindrical surface of the sleeve thus forming reinforced sections on either side of the thinnest zone 6. On the other hand, longitudinal ribs 8 are distributed around the rest of the periphery of the compressed sleeve 4, some coming together under the support ear 9 of the prechamber and then diverging along the surface of the sleeve as shown in FIG. 2. Other than these ribs supporting the ear 9, the ribs 8 and reinforcements 7 are essentially equidistant on the liner periphery. Their length will be limited to the level 10, as indicated in FIGS. 1 and 2, in the case where the shape of the block limits the dimensions of the shoulder 2.

More generally, the compressed type of internal combustion engine liner of the invention is characterized by the fact that the thickness 4 of the compressed part is reinforced while maintaining a reduced interaxial distance between cylinders through the provision of two longitudinal flats 5 perpendicular to the plane of the cylinders and diametrically opposed. The resultant reduced thickness 6 of the liner is compensated for by joining the said flats 5 with concave roundings 7 to the surface of the liner, thus forming thick reinforcements on the two sides of the thinnest zone 6. Longitudinal reinforcing ribs 8, essentially equidistant with the reinforcements 7, are distributed around the liner periphery.

The ribs 8 and reinforcement zones 7 stop at a level 10 at a slight distance from the support shoulder 2 in the motor cylinder block when this may permit provision of a reduced support flange 2, notably in compact engines.

In the case of heads with a prechamber, an ear 9 for support of the prechamber on the face 1 in contact with the head is reinforced by two longitudinal ribs 8 which then separate along the sleeve surface. The ribs 8, and zones of reinforcement 7 of flats 5, will have a radial thickness essentially equal to their width and are joined to the liner surface by round-offs of a radius at least equal to this width as shown in the figures where the radial thicknesses and widths of the ribs 8 and reinforcement zones 7 are slightly less than the thickness 4 of the compressed zone of the liner.

These proportions facilitate the fabrication of the liners by casting in centrifugal chill-molds.

Thus, the described figures represent a ribbed liner in the case of a Diesel engine with a precombustion chamber provided on the lower face of the head, as in the type described in the French Patent Application No. 76/17030 in the name of the applicant. The block of this motor may be of aluminum cast under pressure to reduce the weight and increase heat transfer, the interaxial distance between cylinders being reduced to the minimum thanks to flats 5 milled on the peripheral surface of the liner for the height of the liner in the water jacket, the water jacket permitting circulation of water between liners; the zones 6 made thin by the flats 5 being reinforced by the adjacent ridges 7.

Two longitudinal ribs 8 parallel to the axis of the liner and essentially equidistant from themselves and the end ridges 7 run along the half of the liner opposite to the prechamber. The latter, installed in the head, rests against the ear 9 formed by the upper flange of the liner. This ear is supported by two ribs 8 which diverge in order to diffuse the strong forces of compression engendered by the passage from the prechamber with respect to the head surface and to stiffen the barrel of the liner at the most appropriate places.

All of the ribs stop at 10 a little before the lower support point 2 of the liner in the block, their projections on the plane of support in the block being conditioned by the possibilities of machining the latter.

Thus, thanks to this type of construction, wet and compressed liners may be employed in Diesel engines with a prechamber installed in the head face while using large tightening forces in order to obtain a high pressure in the sealing zones which assures the long life of the head gasket and the dispensing with retightening. The advantage inherent in the use of these liners, as pointed out above, are thus made available to the motorist and particularly of the dieselist without subjecting the liners to deformations prejudicial to piston wear.

Naturally, even in the case of less demanding applications such as in gasoline engines or small bore engines, the ribbed liners still afford, by a better use of materials as a function of their role, the benefit of the advantages enumerated above.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A liner of the compressed type for an internal combustion engine having at least one cylinder, said liner comprising:

a cylindrical barrel having a predetermined thickness including a compressed portion;

means for maintaining a reduced interaxial distance between said cylinders, said means for maintaining a reduced interaxial distance including two opposed longitudinal flat portions on the outer surface of said liner and lying in planes which are perpendicular to the plane of the ends of said cylinders, the cylinder wall thickness at a mid portion of said flat portions is less than said predetermined thickness and the cylinder wall thickness adjacent the ends of said flat portions are greater than said predetermined thickness; and means for reinforcing the thickness of said compressed portion, said means for reinforcing including concave roundoffs of longitudinal ends of said flat portions forming reinforcement zones and longitudinal reinforcement ribs circumferentially equidistantly spaced between said flats along the surface of said barrel.

2. The liner of claim 1 wherein said liner includes a shoulder for support by said engine and wherein said ribs and reinforcement zones of said flat portions extend to a point adjacent to and slightly removed from said shoulder.

3. The liner of claim 1 wherein an end of said liner includes an ear for supporting a prechamber in contact with said liner, said ear being reinforced by two longitudinal ribs, said ribs extending from said ear in a parallel fashion and then diverging at a point along their length.

4. The liner of claim 1 wherein said ribs and said reinforcement zones of said flat portions have a radial thickness substantially equal to their widths and wherein the intersections of said ribs with said barrel are formed with round-offs, said round-offs of said flat portions and of said ribs all having radii substantially equal to said widths of said ribs and said reinforcement zones.

5. The liner of claim 1 wherein the radial thickness and width of said ribs and said reinforcement zones are slightly less than the thickness of said compressed portion of said barrel.

* * * * *